US008750775B2

(12) United States Patent
Ishida et al.

(10) Patent No.: US 8,750,775 B2
(45) Date of Patent: Jun. 10, 2014

(54) FIXING DEVICE HAVING GUIDE FOR GUIDING MOVEMENT OF FUSING BELT

(75) Inventors: Kei Ishida, Nagoya (JP); Noboru Suzuki, Komaki (JP); Takuji Matsuno, Ichinomiya (JP); Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 253 days.

(21) Appl. No.: 13/426,653

(22) Filed: Mar. 22, 2012

(65) Prior Publication Data

US 2012/0275831 A1 Nov. 1, 2012

(30) Foreign Application Priority Data

Apr. 28, 2011 (JP) ..... 2011-101172

(51) Int. Cl.
*G03G 15/20* (2006.01)

(52) U.S. Cl.
CPC ..... *G03G 15/2075* (2013.01)
USPC ..... 399/329

(58) Field of Classification Search
CPC ..... G03G 15/2025; G03G 15/2075
USPC ..... 399/328, 329
See application file for complete search history.

(56) References Cited

U.S. PATENT DOCUMENTS 5,278,618 A 1/1994 Mitani et al.
7,027,763 B2 * 4/2006 Kato et al. ..... 399/329
7,235,761 B1 6/2007 Maul et al.
7,386,265 B2 6/2008 Ito et al.
7,406,286 B2 7/2008 Yoshioka et al.
7,437,110 B2 10/2008 Kondo et al.
7,890,040 B2 2/2011 Lee et al.
7,986,909 B2 * 7/2011 Nanba ..... 399/329
8,032,069 B2 10/2011 Shin et al.

(Continued)

FOREIGN PATENT DOCUMENTS

JP 04-044074 2/1992
JP 07-287461 10/1995

(Continued)

OTHER PUBLICATIONS

Non-Final Office Action received in U.S. Appl. No. 13/426,662 mailed Oct. 23, 2013.

(Continued)

*Primary Examiner* — William J Royer
(74) *Attorney, Agent, or Firm* — Banner & Witcoff, Ltd.

(57) ABSTRACT

A fixing device includes: a tubular member; a heater; a nip member including a base portion, a connecting portion, and a flange portion; a backup member; and a guide member. The tubular member is circularly movable in a circularly-moving direction. The guide member has a part positioned upstream of the nip member in the circularly-moving direction and configured to guide the tubular member. The part has an end portion containing a most downstream end at which the tubular member is directed to a position between the nip member and the backup member. The nip member and the guide member define a first imaginary plane containing a line connecting a first curved portion provided by a boundary region between the connecting portion and the base portion, and the most downstream end. The first imaginary plane is positioned opposite to the heater relative to a first end of the flange portion.

15 Claims, 4 Drawing Sheets

(56) References Cited

U.S. PATENT DOCUMENTS

| | | | | |
|---|---|---|---|---|
| 8,121,528 | B2 | 2/2012 | Pawlik et al. | |
| 8,606,135 | B2 * | 12/2013 | Yamashina et al. | 399/329 |
| 2004/0151522 | A1 | 8/2004 | Kato et al. | |
| 2010/0266319 | A1 | 10/2010 | Matsuoka et al. | |
| 2010/0290822 | A1 | 11/2010 | Hasegawa et al. | |
| 2011/0150543 | A1 | 6/2011 | Fujiwara et al. | |
| 2011/0158716 | A1 | 6/2011 | Fujiwara et al. | |
| 2011/0170920 | A1 | 7/2011 | Fujiwara et al. | |
| 2012/0275831 | A1 | 11/2012 | Ishida et al. | |
| 2013/0071157 | A1 | 3/2013 | Suzuki et al. | |

FOREIGN PATENT DOCUMENTS

| | | | |
|---|---|---|---|
| JP | 08-248791 | | 9/1996 |
| JP | 2003-223064 | | 8/2003 |
| JP | 2003-295671 | | 10/2003 |
| JP | 2004-184814 | | 7/2004 |
| JP | 2004286933 | A | 10/2004 |
| JP | 2005-114959 | | 4/2005 |
| JP | 2005242113 | A | 9/2005 |
| JP | 2006-047769 | | 2/2006 |
| JP | 2010-009781 | | 1/2010 |
| JP | 2010-230774 | | 10/2010 |
| JP | 2010-286815 | | 12/2010 |
| JP | 2010282237 | A | 12/2010 |
| JP | 2011033654 | A | 2/2011 |
| JP | 2011-095549 | | 5/2011 |
| JP | 2011-095550 | | 5/2011 |
| JP | 2011-137933 | | 7/2011 |

OTHER PUBLICATIONS

Co-pending U.S. Appl. No. 13/426,662, filed Mar. 22, 2012.
Co-pending U.S. Appl. No. 13/426,648, filed Mar. 22, 2012.
Co-pending U.S. Appl. No. 13/426,656, filed Mar. 22, 2012.
Non-Final Office Action mailed Aug. 27, 2013, U.S. Appl. No. 13/426,648.

* cited by examiner

FIXING DEVICE HAVING GUIDE FOR GUIDING MOVEMENT OF FUSING BELT

CROSS REFERENCE TO RELATED APPLICATION

This application claims priority from Japanese Patent Application No. 2011-101172 filed Apr. 28, 2011. The entire content of the priority application is incorporated herein by reference.

TECHNICAL FIELD

The present invention relates to a fixing device that thermally fixes a transferred developing agent image to a sheet.

BACKGROUND

A conventional fixing device employed for an electrophotographic type image forming device includes a circularly movable tubular fusing belt (tubular member) having an inner peripheral surface defining an internal space, a halogen lamp disposed in the internal space, a plate-shaped pressure support member (nip plate) with which the inner peripheral surface is in sliding contact, and a pressure roller for nipping the fusing belt in cooperation with the nip plate.

SUMMARY

In the above-described conventional fixing device, inventors of the present application has proposed to provide a retaining portion in the nip plate at a position confronting the inner peripheral surface of the tubular member. For fabricating the retaining portion, an end portion of the nip plate is folded inward of the tubular member in a stepped manner for retaining a lubricant agent therein. With this configuration, as the tubular member circularly moves, the lubricant agent enters between the nip plate and the tubular member. Accordingly, friction between the nip plate and tubular member can be reduced at a position between the nip plate and the pressure roller.

However, the folded portion of the nip plate has an edge that may provide direct frictional contact with the inner peripheral surface of the tubular member conveyed between the nip plate and the pressure roller. Direct frictional contact between the edge of the folded portion and the inner peripheral surface may cause increase in torque exerted on the tubular member or damages to the inner peripheral surface.

In view of the foregoing, it is an object of the present invention to provide a fixing device provided with a smoothly circularly movable tubular member.

In order to attain the above and other objects, the present invention provides a fixing device for thermally fixing a developing agent image to a sheet fed in a sheet feeding direction including: a flexible tubular member; a heater; a nip member; a backup member; and a guide member. The flexible tubular member has an inner peripheral surface defining an internal space and is circularly movable in a circularly-moving direction. The heater is disposed in the internal space. The nip member is disposed in the internal space and made of a metal plate. The inner peripheral surface is configured to be in sliding contact with the nip member. The nip member confronts the heater in a confronting direction. The backup member is configured to provide a nip region in cooperation with the nip member for nipping the flexible tubular member between the backup member and the nip member. The guide member is disposed in the internal space and has a part positioned upstream of the nip member in the circularly-moving direction. The part is configured to guide the flexible tubular member. The part has an end portion containing a most downstream end at which the flexible tubular member is directed to a position between the nip member and the backup member. The nip member includes: a base portion; a connecting portion; and a flange portion. The base portion has a first end and a second end positioned downstream of the first end in the sheet feeding direction. The nip region is defined exclusively by the base portion and the backup member. The connecting portion extends from the first end of the base portion and is bent in a direction away from the backup member. The connecting portion has a first end and a second end connected to the first end of the base portion. A boundary region between the second end of the connecting portion and the first end of the base portion provides a first curved portion. The flange portion extends from the first end of the connecting portion in a direction opposite to the sheet feeding direction, and has a first end and a second end connected to the first end of the connecting portion. The flange portion defines a retaining portion in cooperation with the connecting portion at a position confronting the inner peripheral surface of the flexible tubular member for retaining a lubricant agent. The nip member and the guide member define a first imaginary plane containing a line connecting the first curved portion and the most downstream end. The first imaginary plane is positioned opposite to the heater relative to the first end of the flange portion.

According to another aspect, the present invention provides a fixing device for thermally fixing a developing agent image to a sheet fed in a sheet feeding direction including: a flexible tubular member; a heater; a nip member; a backup member; and a guide member. The flexible tubular member has an inner peripheral surface defining an internal space and is circularly movable in a circularly-moving direction. The heater is disposed in the internal space. The nip member is disposed in the internal space and made of a metal plate. The inner peripheral surface is configured to be in sliding contact with the nip member. The nip member is confronting the heater in a confronting direction. The backup member is configured to provide a nip region in cooperation with the nip member for nipping the flexible tubular member between the backup member and the nip member. The guide member is disposed in the internal space and has a part positioned upstream of the nip member in the circularly-moving direction. The part is configured to guide the flexible tubular member. The part has an end portion containing a most downstream end at which the flexible tubular member is directed to a position between the nip member and the backup member. The nip member includes: a base portion; a connecting portion; and a flange portion. The base portion has a first end and a second end positioned downstream of the first end in the sheet feeding direction. The nip region is defined exclusively by the base portion and the backup member. The connecting portion extends from the first end of the base portion and is bent in a direction away from the backup member. The connecting portion has a first end and a second end connected to the first end of the base portion. A boundary region between the second end of the connecting portion and the first end of the base portion provides a first curved portion. The flange portion extends from the first end of the connecting portion in a direction opposite to the sheet feeding direction and has a first end and a second end connected to the first end of the connecting portion. The flange portion defines a retaining portion in cooperation with the connecting portion at a position confronting the inner peripheral surface of the flexible tubular member for retaining a lubricant agent. The nip region defines an imaginary plane in the sheet feeding direction. The distance between the most downstream end and the imaginary plane is smaller than a distance between the first end and the imaginary plane.

DETAILED DESCRIPTION

Next, a general structure of a laser printer 1 as an image forming device provided with a fixing device 100 according to one embodiment of the present invention will be described with reference to FIG. 1. A detailed structure of the fixing device 100 will be described later while referring to FIGS. 2 and 3.

Throughout the specification, the terms "above", "below", "right", "left", "front", "rear" and the like will be used assuming that the laser printer 1 is disposed in an orientation in which it is intended to be used. More specifically, in FIG. 1, a left side and a right side are a rear side and a front side, respectively. Further, in FIG. 1, a near side and a far side are a left side and a right side, respectively.

<General Structure of Laser Printer>

Figure 1:
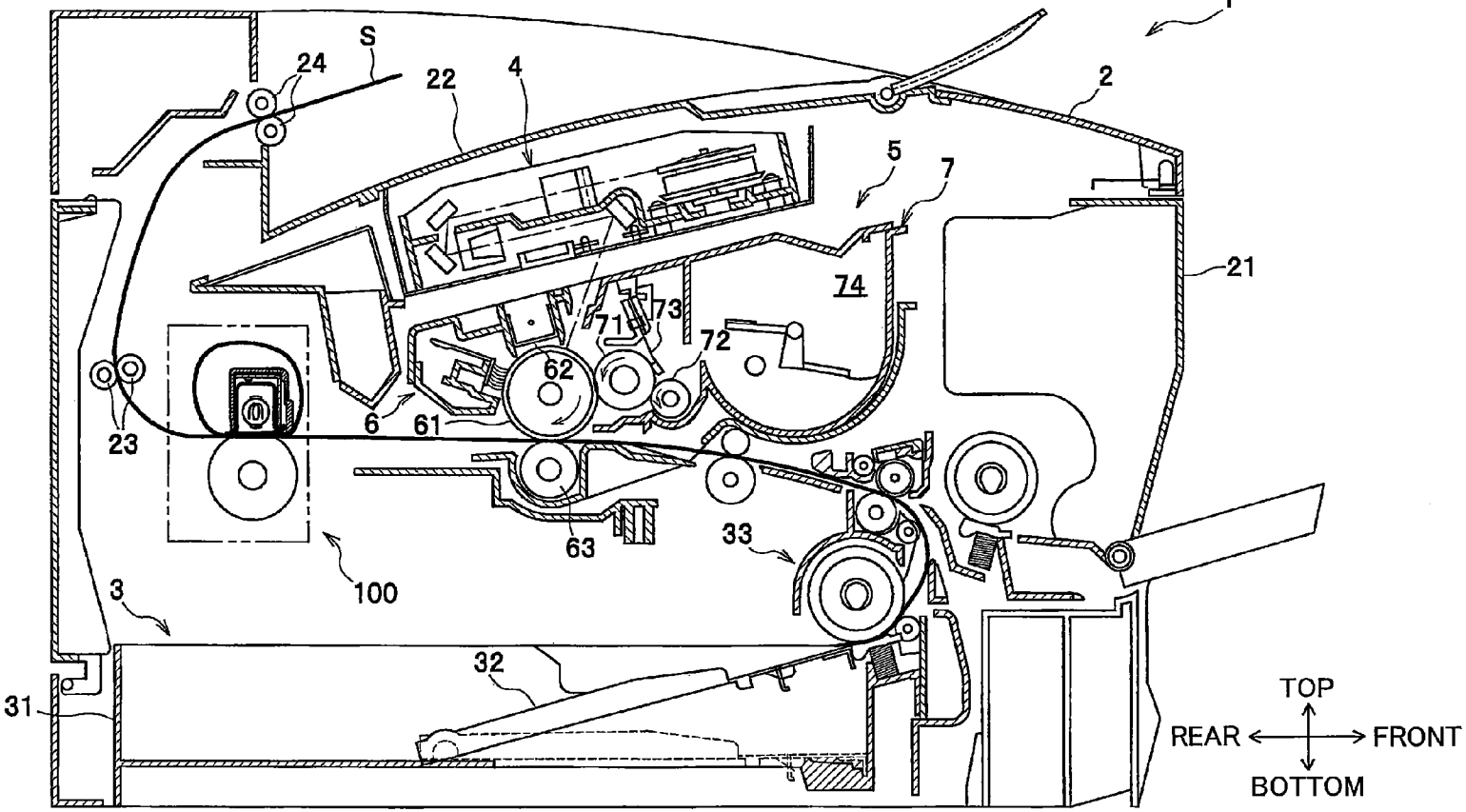
FIG. 1 is a schematic cross-sectional view showing a structure of a laser printer having a fixing device according to one embodiment of the present invention.

As shown in FIG. 1, the laser printer 1 includes a main frame 2 with a movable front cover 21. Within the main frame 2, a sheet supply unit 3 for supplying a sheet 0, an exposure unit 4, a process cartridge 5 for transferring a toner image (developing agent image) on the sheet S, and the fixing device 100 for thermally fixing the toner image onto the sheet S are provided.

The sheet supply unit 3 is disposed at a lower portion of the main frame 2. The sheet supply unit 3 includes a sheet supply tray 31, a lifter plate 32, a sheet feeding mechanism 33. Each sheet S accommodated in the sheet supply tray 31 is directed upward by the lifter plate 32, and conveyed toward the process cartridge 5 (i.e. between a photosensitive drum 61 and a transfer roller 63) by the sheet feeding mechanism 33.

The exposure unit 4 is disposed at an upper portion of the main frame 2. The exposure unit 4 includes a laser emission unit (not shown), a polygon mirror (shown but without a reference numeral), lenses (shown but without reference numerals), and reflection mirrors (shown but without reference numerals). In the exposure unit 4, the laser emission unit irradiates a laser beam (indicated by a chain line in FIG. 1) based on image data, thereby exposing a surface of the photosensitive drum 61 with high speed scan of the laser beam.

The process cartridge 5 is disposed below the exposure unit 4. The process cartridge 5 is detachable from or attachable to the main frame 2 through a front opening defined when the front cover 21 of the main frame 2 is open. The process cartridge 5 includes a drum unit 6 and a developing unit 7.

The drum unit 6 includes the photosensitive drum 61, a charger 62, and the transfer roller 63. The developing unit 7 is detachably mounted in the drum unit 6. The developing unit 7 includes a developing roller 71, a supply roller 72, a thickness-regulation blade 73, and a toner accommodating portion 74 in which toner (developing agent) is accommodated.

In the process cartridge 5, after the surface of the photosensitive drum 61 has been uniformly charged by the charger 62, the surface is exposed to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the supply roller 72. The toner then enters between the developing roller 71 and the thickness-regulation blade 73 to be carried on the developing roller 71 as a thin layer having a uniform thickness.

The toner carried on the developing roller 71 is supplied to the electrostatic latent image formed on the photosensitive drum 61. Hence, a visible toner image corresponding to the electrostatic latent image is formed on the photosensitive drum 61. Then, the sheet S is conveyed between the photosensitive drum 61 and the transfer roller 63, so that the toner image formed on the photosensitive drum 61 is transferred onto the sheet S.

The fixing device 100 is disposed rearward of the process cartridge 5. The toner image (toner) transferred onto the sheet S is thermally fixed onto the sheet S while the sheet S passes through the fixing device 100. The sheet S on which the toner image is thermally fixed is conveyed by conveying rollers 23, 24 to be discharged onto a discharge tray 22 formed on the top of the main frame 2.

<Detailed Structure of Fixing Device>

Figure 2:
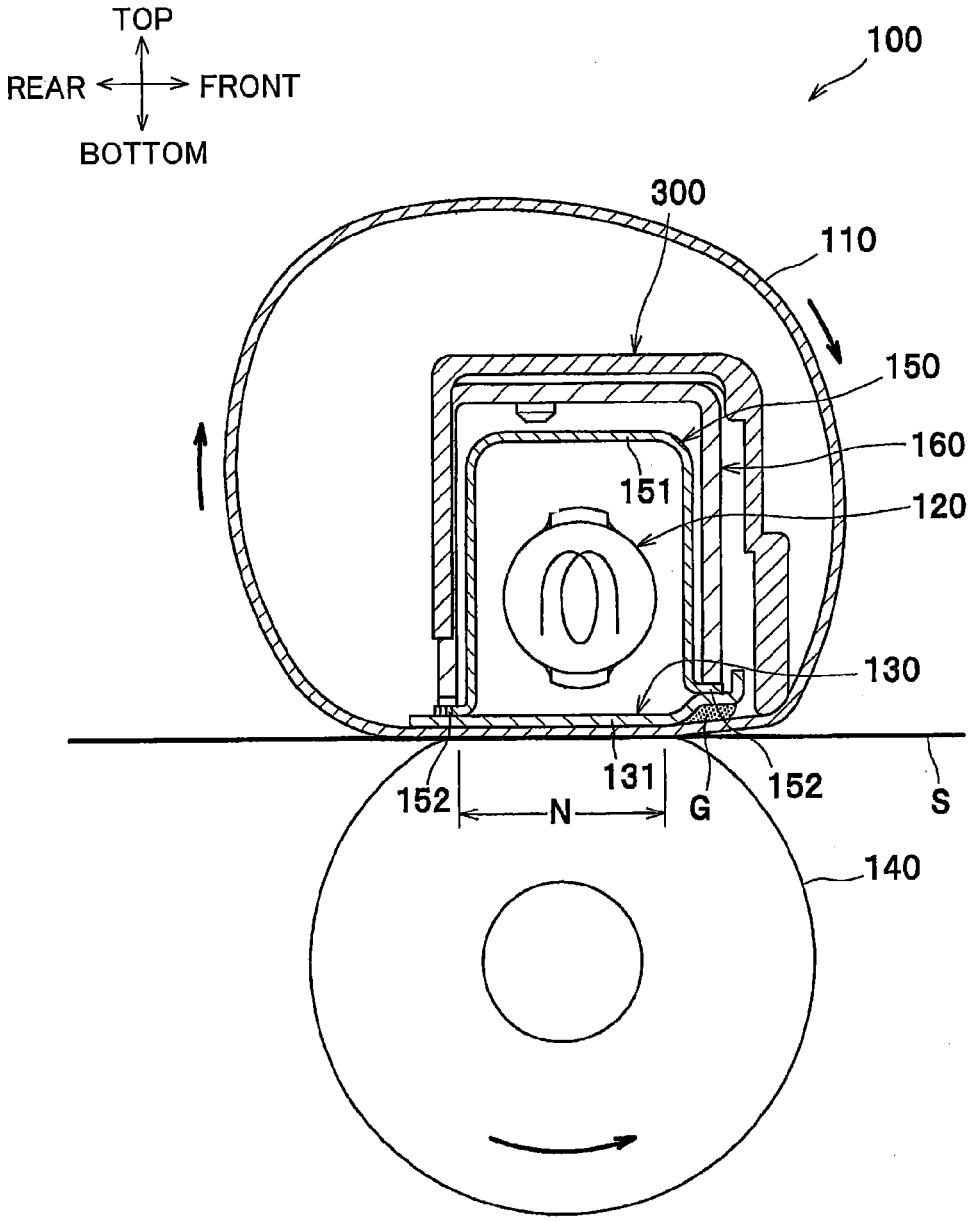
FIG. 2 is a schematic cross-sectional view of the fixing device according to the embodiment.

As shown in FIG. 2, the fixing device 100 includes a flexible tubular fusing belt (tubular member) 110, a halogen lamp (heater) 120, a nip plate (nip member) 130, a pressure roller (backup member) 140, a reflection member 150, a stay 160, and a guide member 300.

The fusing belt 110 is an endless belt having a tubular configuration with heat resistivity and flexibility. The fusing belt 110 has an inner peripheral surface defining an internal space within which the halogen lamp 120, the nip plate 130, the reflection member 150, the stay 160, and the guide member 300 are disposed. The fusing belt 110 has widthwise (right and left) end portions that are respectively guided by guide members (not shown) fixed to a casing (not shown) of the fixing device 100 so that the fusing belt 110 is circularly movable. Further, circular movement of the fusing belt 110 is also guided by the guide member 300 (described later) as will be described later in detail.

The fusing belt 110 may be formed of any material. For example, the fusing belt 110 may be formed of a metal such as stainless steel, or a resin such as polyimide resin, or an elastic material such as rubber.

Further, the fusing belt 110 may be of a multilayered configuration. The fusing belt 110 may be a metal belt whose outer peripheral surface has a resin layer for reducing sliding resistance, or alternatively, an elastic layer such as a rubber layer.

The halogen lamp 120 is a heater to generate a radiant heat to heat the nip plate 130 and the fusing belt 110 (nip region N) for heating toner on the sheet S. The halogen lamp 120 is positioned at the internal space of the fusing belt 110 such that the halogen lamp 120 is spaced away from the inner peripheral surface of the fusing belt 110 as well as an inner (upper) surface of the nip plate 130 by a predetermined distance.

The nip plate 130 is adapted for receiving the radiant heat from the halogen lamp 120. To this effect, the nip plate 130 is stationarily positioned such that the inner peripheral surface of the fusing belt 110 is moved slidably with a lower surface of the nip plate 130.

The nip plate 130 is made from a material such as aluminum having a thermal conductivity higher than that of the stay 160 (described later) made from a steel. More specifically, for fabricating the nip plate 130, a metal plate such as an aluminum plate is bent to provide a base portion 131, a connecting portion 132, a flange portion 133, and a prevention portion 134.

The base portion 131 is formed in a plate shape extending flat in a frontward/rearward direction. The inner peripheral surface of the fusing belt 110 is moved slidably with a lower surface of the base portion 131, so that the base portion 131 exclusively nips the fusing belt 110 in cooperation with the pressure roller 140. The lower surface of the base portion 131 is substantially uniformly flat across the entire region in a sheet feeding direction of the sheet S (i.e. frontward/rearward direction) as well as in an axial direction of the fusing belt 110 (i.e. rightward/leftward direction). The base portion 131 has a front end portion, and a rear end portion positioned downstream of the front end portion in the sheet feeding direction.

The connecting portion 132 extends diagonally upward and frontward from the front end portion of the base portion 131. That is, the connecting portion 132 extends from the base portion 131 in a direction away from the pressure roller 140. The connecting portion 132 is formed so as to connect the base portion 131 and the flange portion 133. The connecting portion 132 has a front end portion, and a rear end portion positioned downstream of the front end portion in the sheet feeding direction.

The flange portion 133 extends from the front end portion of the connecting portion 132 in a direction opposite to the sheet feeding direction. That is, the flange portion 133 extends frontward from the connecting portion 132. The flange portion 133 has a front end portion, and a rear end portion positioned downstream of the front end portion in the sheet feeding direction. The connecting portion 132 and the flange portion 133 form a generally inverted V-shape to define a retaining portion 137 at a position confronting the inner peripheral surface of the fusing belt 110. The retaining portion 137 is adapted to retain a lubricant agent G therein.

The lubricant agent G retained in the retaining portion 137 enters between the nip plate 130 (the base portion 131) and the fusing belt 110 in association with circular movement of the fusing belt 110, thereby reducing friction between the nip plate 130 and the fusing belt 110. As the lubricant agent G, a heat resisting fluorine grease is available, for example.

The prevention portion 134 extends from the front end portion of the flange portion 133 in the direction away from the pressure roller 140. That is, the prevention portion 134 extends upward from the flange portion 133. The prevention portion 134 is formed so as to cover a flange portion 152 (described later) of the reflection member 150 nipped between the nip plate 130 and the stay 160 when viewing in the sheet feeding direction. That is, the flange portion 133 of the nip plate 130 and a lower end portion 161 of the front side wall of the stay 160 are adjoined to each other to define an adjoining region therebetween, and the prevention portion 134 is provided to cover the adjoining region.

Since the prevention portion 134 serves as a barrier against the lubricant agent G, the prevention portion 134 can prevent the lubricant agent G from running over an upper surface of the nip plate 130, that is, a surface opposite to the lower surface of the nip plate 130 with which the fusing belt 110 is in sliding contact. Further, the prevention portion 134 can prevent the lubricant agent G from entering into the adjoining region between the nip plate 130 and the stay 160. Hence, unintentional consumption of the lubricant agent G retained between the nip plate 130 and the fusing belt 110 (in the retaining portion 137) can be restrained.

Further, the base portion 131 and the connecting portion 132 define a boundary region therebetween to provide a first curved portion B1, and the flange portion 133 and the prevention portion 134 define a boundary region therebetween to provide a second curved portion B2. The first curved portion B1 and the second curved portion B2 are positioned upstream of the rear end portion of the base portion 131 in the sheet feeding direction as well as in a circularly-moving direction of the fusing belt 110. In the present embodiment, the first curved portion B1 has a curvature smaller than that of the second curved portion B2. In other words, the first curved portion B1 has a generally obtuse angle, while the second curved portion B2 has a generally right angle.

Here, the first curved portion B1 is positioned at the front end portion of the base portion 131. Due to this configuration, the inner peripheral surface of the fusing belt 110 may frictionally contact the first curved portion B1 while conveyed between the nip plate 130 (the base portion 131) and the pressure roller 140. The first curved portion B1 is formed so as to have a small curvature, therefore, increase in torque associated with circular movement of the fusing belt 110, and damages to the inner peripheral surface of the fusing belt 110 such as scratches and frictional wearing can be restrained.

As shown in FIG. 2, the pressure roller 140 is positioned below the nip plate 130 and nips the fusing belt 110 in cooperation with the nip plate 130 (the base portion 131) to provide the nip region N for nipping the sheet S between the pressure roller 140 and the fusing belt 110. In the present embodiment, the nip region N is defined exclusively by the base portion 131 of the nip plate 130 and the pressure roller 140.

In the present embodiment, for providing the nip region N between the pressure roller 140 and the fusing belt 110, either one of the nip plate 130 or the pressure roller 140 presses the remaining one of the nip plate 130 or the pressure roller 140 through the fusing belt 110.

The pressure roller 140 is rotationally driven by a drive motor (not shown) disposed in the main frame 2. By the rotation of the pressure roller 140, the fusing belt 110 is circularly moved along the nip plate 130 because of a friction force generated therebetween or between the sheet S and the fusing belt 110. A toner image on the sheet S can be thermally fixed thereto by heat and pressure during passage of the sheet S at the nip region N between the pressure roller 140 and the fusing belt 110.

Although not shown in the drawing, in the present embodiment, the pressure roller 140 is formed in an inverted crown shape having a diameter gradually increasing toward each widthwise (right and left) end thereof. The inverted crown shaped pressure roller 140 can prevent the fusing belt 110 from being crumpled and being displaced rightward or leftward while the fusing belt 110 is conveyed between the nip plate 130 and the pressure roller 140.

The reflection member 150 is adapted to reflect the radiant heat (radiating frontward, rearward, and upward) from the halogen lamp 120 toward the nip plate 130. The reflection member 150 is positioned within the fusing belt 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing belt 110.

The reflection member 150 is configured into U-shape in cross-section and is made from a material such as aluminum having high reflection ratio regarding infrared ray and far infrared ray. The reflection member 150 has a U-shaped reflection portion 151, and front and rear flange portions 152 extending outward in the frontward/rearward direction from front and rear end, portions of the reflection portion 151.

The stay 160 is adapted to support the front and rear end portions of the nip plate 130. The stay 160 is positioned within the fusing belt 110 and covers the halogen lamp 120 and the reflection member 150. For fabricating the stay 160, a highly rigid member such as a steel plate is folded into U-shape in conformity with the outer shape of the reflection portion 151 to have a top wall, a front side wall, and a rear side wall.

Figure 3:
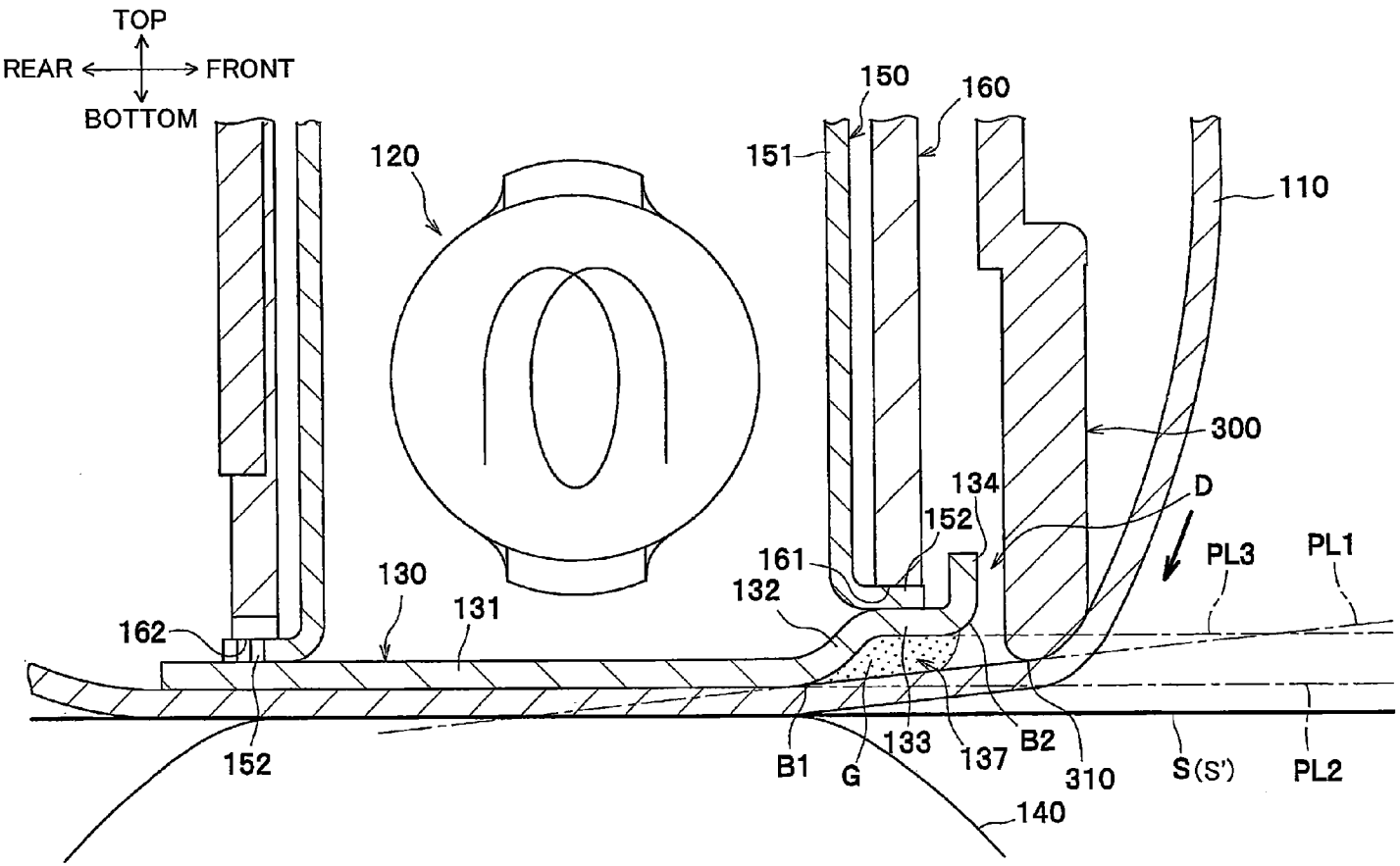
FIG. 3 is an enlarged cross-sectional view of the fixing device according to the embodiment.

More specifically, the stay 160 is positioned at a side opposite to the pressure roller 140 relative to the nip plate 130. As shown in FIG. 3, the front side wall of the stay 160 is provided with a lower end portion 161, and the rear side wall of the stay 160 is provided with a lower end portion 162. The lower end portion 161 supports the flange portion 133 of the nip plate 130 via the front flange portion 152 of the reflection member 150 from above, while the lower end portion 162 supports the rear end portion of the base portion 131 via the rear flange portion 152 of the reflection member 150 from above. The rear end portion of the base portion 131 supported by the lower end portion 162 is positioned downstream of the nip region N.

When a force directed upward is applied to the nip plate 130 from below (a pressure roller 140 side), the stay 160 receives the force to support the nip plate 130. Note that the term "force" here implies a pressure force from the pressure roller 140 when the fixing device 100 has a configuration such that the pressure roller 140 presses the nip plate 130. Alternatively, when the fixing device 100 has a configuration such that the nip plate 130 presses the pressure roller 140, the term "force" here implies a reactive force associated with a pressure force from the nip plate 130.

Because the flange portion 133 and the rear end portion of the base portion 131 are supported to the stay 160 via the front and rear flange portions 152 of the reflection member 150, respectively, the upper surface of the base portion 131 and the upper surface of the connecting portion 132 can be positioned in direct confrontation with the halogen lamp 120. As a result, the base portion 131 and the connecting portion 132 are directly heated by radiant heat from the halogen lamp 120 and the reflection member 150.

With this configuration, the retaining portion 137 can also efficiently be heated by heat conducted through the connecting portion 132, thereby promptly heating the lubricant agent G retained in the retaining portion 137 to have an appropriate viscosity. As a result, even if the fixing device 100 is operated at a low temperature in winter or in cold climates, the lubricant agent G can be promptly heated, thereby promptly reducing friction between the nip plate 130 and the fusing belt 110. Therefore, smooth circular movement of the fusing belt 110 can be attained.

The guide member 300 is adapted to guide the fusing belt 110 to direct the fusing belt 110 toward a position between the nip plate 130 and the pressure roller 140. The guide member 300 is positioned at the internal space of the fusing belt 110 and covers the stay 160. The guide member 300 is fixed to the stay 160. The guide member 300 is made from a material such as a liquid-crystal polymer, a PEEK (Polyether Ether Ketone) resin, and a PPS (Poly Phenylene Sulfide) resin.

The guide member 300 has a generally U-shaped cross-section surrounding the stay 160 (FIG. 2). The guide member 300 has a front side wall provided with a lower end portion 310 with which the inner peripheral surface of the fusing belt 110 is in sliding contact. It is the lower end portion 310 that guides the circularly movable fusing belt 110 toward the position between the nip plate 130 and the pressure roller 140. More specifically, the lower end portion 310 contains a most downstream end in the circularly-moving direction of the fusing belt 110 (indicated by an arrow in FIG. 3), at which the fusing belt 110 is directed to the position between the nip plate 130 and the pressure roller 140.

The lower end portion 310 of the guide member 300 is positioned immediately upstream of the front end portion of the nip plate 130 (the second curved portion B2) in the circularly-moving direction, and guides the fusing belt 110 such that the fusing belt 110 is directed to the position between the nip plate 130 and the pressure roller 140. No member for directing the fusing belt 110 to the position between the nip plate 130 and the pressure roller 140 other than the guide member 300 is provided at a position between the lower end portion 310 and the nip plate 130.

The lower end portion 310 extends in an axial direction of the fusing belt 110 across the entire axial length of the fusing belt 110. In order to guide smooth circular movement of the fusing belt 110 toward the nip region, the lower end portion 310 is rounded and protrudes toward the inner peripheral surface of the fusing belt 110 such that the inner peripheral surface of the fusing belt 110 is separated from the lower end portion at the most downstream end. More specifically, the lower end portion 310 has a lower rounded surface and a vertical uniform cross-section protruding toward the inner peripheral surface of the fusing belt 110.

The nip plate 130 and the guide member 300 define an imaginary plane PL1 containing a line connecting the first curved portion B1 of the nip plate 130 and the most downstream end of the lower end portion 310 of the guide member 300. The nip plate 130 and the guide member 300 are arranged such that the second curved portion B2 of the nip plate 130 is positioned above the imaginary plane PL1 at a position within the fusing belt 110. In other words, the imaginary plane PL1 is positioned opposite to the halogen lamp 120 with respect to the second curved portion B2.

Further, the nip region N defines an imaginary plane S' in the sheet feeding direction. A distance between the most downstream end of the lower end portion 310 and the imaginary plane S' is smaller than a distance between the second curved portion B2 of the nip plate 130 and the imaginary plane S'.

Further, the nip plate 130 defines an imaginary plane PL2 containing a contact surface (lower surface) of the base portion 131 with which the fusing belt 110 is in sliding contact and an imaginary plane PL3 containing a lower surface of the flange portion 133 in confrontation with the pressure roller 140. The most downstream end of the lower end portion 310 is positioned between the imaginary plane PL2 and the imaginary plane PL3 in a confronting direction that the halogen lamp 120 confronts the nip plate 130. More specifically, the most downstream end of the lower end portion 310 is positioned above the imaginary plane PL2 and below the imaginary plane PL3.

Because the second curved portion B2 is positioned above the imaginary plane PL1 within the fusing belt 110 and the most downstream end of the lower end portion 310 is positioned above the imaginary plane PL2 and below the imaginary plane PL3, direct frictional contact between the inner peripheral surface of the fusing belt 110 and the second curved portion B2 can be avoided.

Here, the second curved portion B2 is formed by folding an aluminum plate (metal plate) at a substantially right angle.

For this reason, the second curved portion B2 may have a rough surface. If the inner peripheral surface of the fusing belt 110 is brought into frictional contact with the rough surface of the second curved portion B2, torque exerted on the circularly moving fusing belt 110 may increase, thereby interrupting smooth circular movement of the fusing belt 110. Further, the rough surface of the second curved portion 132 may cause damages to the inner peripheral surface of the fusing belt 110 such as scratches and frictional wearing.

Because the second curved portion B2 is positioned above the imaginary plane PL1 within the fusing belt 110 and the most downstream end of the lower end portion 310 is positioned above the imaginary plane PL2 and below the imaginary plane PL3, frictional contact between the inner peripheral surface of the fusing belt 110 and the second curved portion B2 can be avoided, thereby restraining increase in torque exerted on the fusing belt 110 and damages to the inner peripheral surface of the fusing belt 110.

Further, the guide member 300 and the nip plate 130 are arranged such that a gap D is formed between the front end portion of the flange portion 133 (the prevention portion 134) and the front side wall of the guide member 300 in the frontward/rearward direction. In other words, the front side wall of the guide member 300 and the front end portion of the nip plate 130 are spaced away from each other by the prescribed gap D in the frontward/rearward direction. The gap D can restrain heat loss to the guide member 300 from the nip plate 130 heated by the halogen lamp 120.

The fixing device 100 according to the above-described embodiment provide the following advantages and effects: within the fusing belt 110, the front end portion of the nip plate 130 (the second curved portion B2) is positioned above the imaginary plane PL1 that contains a line connecting the first curved portion B1 and the most downstream end of the lower end portion 310. Accordingly, direct frictional contact between the inner peripheral surface of the fusing belt 110 and the second curved portion B2 can be avoided.

Further, the nip plate 130 is provided with the retaining portion 137. Since the lubricant agent G retained in the retaining portion 137 enters between the base portion 131 and the fusing belt 110, friction between the nip plate 130 and the fusing belt 110 can be reduced.

As a result, torque exerted on the fusing belt 110 can be reduced, and therefore, smooth circular movement of the fusing belt 110 can be attained. Further, any damages to the inner peripheral surface of the fusing belt 110 such as scratches and frictional wearing can be restrained since direct frictional contact between the inner peripheral surface of the fusing belt 110 and the second curved portion B2 does not occur during circular movement of the fusing belt 110.

In particular, in the present embodiment, the most downstream end of the lower end portion 310 is positioned above the imaginary plane PL2 and below the imaginary plane PL3. Accordingly, direct frictional contact between the inner peripheral surface of the fusing belt 110 and the second curved portion B2 can be reliably avoided. As a result, smooth circular movement of the fusing belt 110 can be ensured. Further, any damages to the inner peripheral surface of the fusing belt 110 such as scratches and frictional wearing can also be restrained.

The nip plate 130 is provided with the prevention portion 134. The prevention portion 134 can prevent the lubricant agent G from entering into the adjoining region defined between the nip plate 130 and the stay 160 or running over the upper surface of the nip plate 130, thereby restraining unintentional consumption of the lubricant agent G retained between the nip plate 130 and the fusing belt 110. Accordingly, smooth circular movement of the fusing belt 110 can be maintained.

The curvature of the first curved portion B1 is smaller than that of the second curved portion B2. Torque exerted on the fusing belt 110 can be reduced when the inner peripheral surface of the fusing belt 110 slidingly contacts the first curved portion B1. Accordingly, smooth circular movement of the fusing belt 110 can be attained. Further, any damages to the inner peripheral surface of the fusing belt 110 such as scratches or frictional wearing can be restrained.

The gap D is formed between the nip plate 130 and the front side wall of the guide member 300, thereby preventing heat from releasing from the nip plate 130 to the guide member 300 (outside). Accordingly, prompt heating to the nip plate 130 can be attained to accelerate start-up timing of the fixing device 100.

Various modifications are conceivable.

Figure 4:
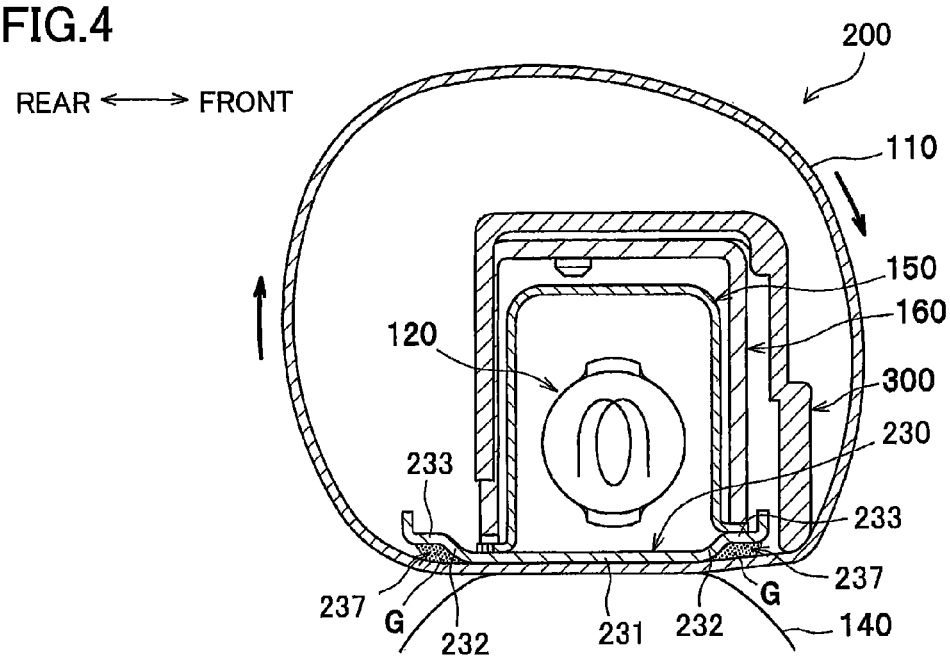
FIG. 4 is a schematic cross-sectional view of a fixing device according to a first modification of the present invention, showing a variation of a nip plate.

A fixing device 200 according to a first modification will be described while referring to FIG. 4. In the following description, only parts differing from those of the above-described embodiment will be described. In the above-described embodiment, the nip plate 130 is provided with only a single retaining portion 137, connecting portion 132, and flange portion 133 at a position forward of the base portion 131. That is, the retaining portion 137, the connecting portion 132, and the flange portion 133 are only provided at a position upstream of the base portion 131 in the sheet feeding direction. However, as shown in FIG. 4, a nip plate 230 may be provided with a base portion 231, two connecting portions 232, two flange portions 233, and two retaining portions 237. One of the connecting portions 232, one of the flange portions 233, and one of the retaining portions 237 are positioned forward of the base portion 231, whereas remaining one of the connecting portions 232, remaining one of the flange portions 233, and remaining one of the retaining portions 237 are positioned rearward of the base portion 231. That is, a set of the connecting portion 232, the flange portion 233 and the retaining portion 237 is positioned upstream of the base portion 231 in the sheet feeding direction, whereas another set of the connecting portion 232, the flange portion 233, and the retaining portion 237 is positioned downstream of the base portion 231 in the sheet feeding direction.

A fixing device 300 according to a second modification will be described while referring to FIG. 6. In the following description, only parts differing from those of the above-described embodiment will be described. In the above-described embodiment, the base portion 131 of the nip plate 130 is formed in a plate shape extending flat in the frontward/rearward direction. However, the term "plate shape" here implies a shape without an uneven portion or a folding portion. Accordingly, a nip plate 330 may have a curved base portion 331.

Figure 5:
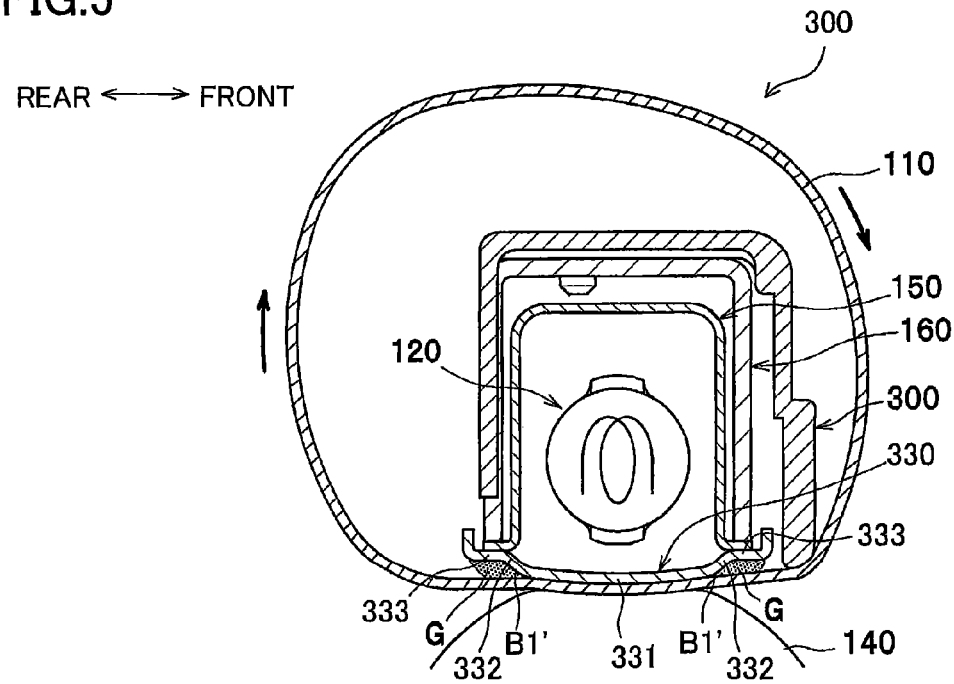
FIG. 5 is a schematic cross-sectional view of a fixing device according to a second modification of the present invention, showing another variation of the nip plate.

For example, as shown in FIG. 5, the base portion 331 (at least a surface with which the fusing belt 110 is in sliding contact) may curve in an arc shape with its convex side facing the pressure roller 140. Alternatively, although not shown in the drawing, the base portion 331 may curve in an arc shape with its convex side facing the halogen lamp 120. Note that, in order to realize smooth circular movement of the fusing belt 110, it is preferable that the base portion 331 has a curvature smaller than a curvature of a first curved portion B1' defined by the base portion 331 and a connecting portion 332.

Further, in the above-described embodiment, the stay 160 supports the flange portion 133 and the rear end portion of the base portion 131 of the nip plate 130. However, as shown in FIG. 5, in case that the nip plate 330 may be provided with two flange portions 333 at positions forward and rearward of the base portion 331, a stay 160 may support the front and rear flange portions 333. At this time, the base portion 331 and the front and rear connecting portions 332 are positioned in direct confrontation with the halogen lamp 120.

In the above-described embodiment, the nip plate 130 is provided with the prevention portion 134. However, the prevention portion 134 is optional and may be dispensed with.

The nip plate 130 without the prevention portion 134 has a front end portion with a sharp edge, compared with a case where the second curved portion B2 is provided at the front end portion of the nip plate 130 as described in the above embodiment. In case that the inner peripheral surface of the fusing belt 110 frictionally contacts the front end portion with a sharp edge, it is highly likely to increase torque exerted on the fusing belt 110 and to cause damages to the inner peripheral surface of the fusing belt 110. In such a case, the present invention is particularly effective.

In the above-described embodiment, the fixing device 100 is adapted to heat the fusing belt 110 (tubular member) by the halogen lamp 120 (heater) via the nip plate 130. However, the fixing device 100 may be adapted to heat the tubular member 110 directly by the heater 120. In other words, the nip plate 130 may not necessarily be heated by the heater 120.

In the above-described embodiment, the fixing device 100 includes both of the reflection member 150 and the stay 160. However, the fixing device 100 may include either the stay 160 or the reflection member 150. Alternatively, both of the stay 160 and the reflection member 150 may be dispensed with.

In case that the fixing device 100 includes the stay 160 but not the reflection member 150, the stay 160 has an inner surface confronting the halogen lamp 120 provided with a reflection surface. The reflection surface is adapted to reflect radiant heat from the halogen lamp 120 toward the nip plate 130. In other words, the stay 160 may be integral with the reflection member 150. With this configuration, radiant heat from the halogen lamp 120 can be efficiently concentrated onto the nip plate 130 to promptly heat the nip plate 130 and the fusing belt 110.

Further, no particular space is required for installing the reflection member 150 in the fixing device 100 because the reflection surface is provided in the stay 160 and the reflection member 150 is unnecessary as a discrete component. Accordingly, the stay 160 can be positioned as close as possible to the halogen lamp 120. Hence, the stay 160 and the nip plate 130 can be made more compact with respect to the sheet feeding direction. Therefore, the compact fixing device 100 can be attained. Further, the compact nip plate 130 can reduce heat capacity of the nip plate 130. Accordingly, prompt heating to the nip plate 130 can be attained to accelerate start-up timing of the fixing device 100.

As far as the guide member 300 is adapted to guide the fusing belt 110 to the position between the nip plate 130 and the pressure roller 140, any modifications to the guide member 300 are available. For example, the guide member 300 may be formed in a plate shape elongated in the axial direction of the fusing belt 110 and positioned upstream of the halogen lamp 120 and the nip plate 130 in the sheet feeding direction.

Further, a carbon heater or an induction heater (IH) is available instead of the halogen lamp 120.

In the above-described embodiment, the reflection member 150 is employed as a backup member. However, a belt-like pressure member is also available.

Further, the sheet S can be an OHP sheet instead of plain paper and a postcard.

Further, in the above-described embodiment, the image forming device is the monochromatic laser printer. However, a color laser printer, a copying machine, and a multifunction device provided with an image reading device such as a flatbed scanner are also available.

While the invention has been described in detail with reference to the embodiment thereof, it would be apparent to those skilled in the art that various changes and modifications may be made therein without departing from the spirit of the invention.

What is claimed is:

1. A fixing device for thermally fixing a developing agent image to a sheet fed in a sheet feeding direction comprising:

a flexible tubular member having an inner peripheral surface defining an internal space and circularly movable in a circularly-moving direction;

a heater disposed in the internal space;

a nip member disposed in the internal space and made of a metal plate, the inner peripheral surface being configured to be in sliding contact with the nip member, the nip member confronting the heater in a confronting direction;

a backup member configured to provide a nip region in cooperation with the nip member for nipping the flexible tubular member between the backup member and the nip member; and a guide member disposed in the internal space and having a part positioned upstream of the nip member in the circularly-moving direction, the part being configured to guide the flexible tubular member, the part having an end portion containing a most downstream end at which the flexible tubular member is directed to a position between the nip member and the backup member;

the nip member including:

a base portion having a first end and a second end positioned downstream of the first end in the sheet feeding direction, the nip region being defined exclusively by the base portion and the backup member;

a connecting portion extending from the first end of the base portion and being bent in a direction away from the backup member, the connecting portion having a first end and a second end connected to the first end of the base portion, a boundary region between the second end of the connecting portion and the first end of the base portion providing a first curved portion; and a flange portion extending from the first end of the connecting portion in a direction opposite to the sheet feeding direction and having a first end and a second end connected to the first end of the connecting portion, the flange portion defining a retaining portion in cooperation with the connecting portion at a position confronting the inner peripheral surface of the flexible tubular member for retaining a lubricant agent, the nip member and the guide member defining a first imaginary plane containing a line connecting the first curved portion and the most downstream end, the first imaginary plane being positioned opposite to the heater relative to the first end of the flange portion.

2. The fixing device as claimed in claim 1, wherein the base portion has a surface with which the inner peripheral surface is in sliding contact, and the nip member defines a second imaginary plane containing the surface of the base portion; and wherein the flange portion has a surface in confrontation with the backup member, and the nip member defines a third imaginary plane containing the surface of the flange portion, wherein the most downstream end of the guide member is positioned between the second imaginary plane and the third imaginary plane in the confronting direction.

3. The fixing device as claimed in claim 2, wherein the base portion has a second surface opposite to the surface with which the inner peripheral surface is in sliding contact; and, wherein the nip member further includes a prevention portion extending from the first end of the flange portion in the direction away from the backup member and configured to prevent the lubricant agent from running over the second surface of the base portion.

4. The fixing device as claimed in claim 3, wherein the flange portion and the prevention portion define a boundary region therebetween and the boundary region provides a second curved portion, the first curved portion having a curvature smaller than that of the second curved portion.

5. The fixing device as claimed in claim 1, wherein the first end of the flange portion and the guide member define a gap therebetween.

6. The fixing device as claimed in claim 1, wherein the inner peripheral surface is configured to be in sliding contact with the end portion of the part of the guide member, the end portion being rounded and protruding toward the inner peripheral surface to guide movement of the flexible tubular member toward the nip region such that the inner peripheral surface is separated from the end portion at the most downstream end.

7. The fixing device as claimed in claim 6, wherein the base portion has a surface with which the inner peripheral surface is in sliding contact, and the nip member defines a second imaginary plane containing the surface of the base portion; and wherein the flange portion has a surface in confrontation with the backup member, and the nip member defines a third imaginary plane containing the surface of the flange portion, wherein the most downstream end of the guide member is positioned between the second imaginary plane and the third imaginary plane in the confronting direction.

8. The fixing device as claimed in claim 7, wherein the base portion has a second surface opposite to the surface with which the inner peripheral surface is in sliding contact; and, wherein the nip member further includes a prevention portion extending from the first end of the flange portion in a direction away from the backup member and configured to prevent the lubricant agent from running over the second surface of the base portion.

9. The fixing device as claimed in claim 8, wherein the flange portion and the prevention portion define a boundary region therebetween and the boundary region provides a second curved portion, the first curved portion having a curvature smaller than that of the second curved portion.

10. The fixing device as claimed in claim 6, wherein the first end of the flange portion and the guide member define a gap therebetween.

11. The fixing device as claimed in claim 1, wherein the base portion and the connecting portion are in direct confrontation with the heater.

12. The fixing device as claimed in claim 1, wherein the nip member further includes a second connecting portion and a second flange portion, the second connecting portion extending from the second end of the base portion in the direction away from the backup member and having a first end connected to the second end of the base portion and a second end, the second flange portion extending from the second end of the second connecting portion in the sheet feeding direction, and wherein the second connecting portion and the second flange portion defining a retaining portion at a position confronting the inner peripheral surface of the flexible tubular member for retaining a lubricant agent therein.

13. The fixing device as claimed in claim 1, wherein the base portion is flat.

14. The fixing device as claimed in claim 1, wherein the base portion is curved.

15. A fixing device for thermally fixing a developing agent image to a sheet fed in a sheet feeding direction comprising:

a flexible tubular member having an inner peripheral surface defining an internal space and circularly movable in a circularly-moving direction;

a heater disposed in the internal space;

a nip member disposed in the internal space and made of a metal plate, the inner peripheral surface being configured to be in sliding contact with the nip member, the nip member confronting the heater in a confronting direction;

a backup member configured to provide a nip region in cooperation with the nip member for nipping the flexible tubular member between the backup member and the nip member; and a guide member disposed in the internal space and having a part positioned upstream of the nip member in the circularly-moving direction, the part being configured to guide the flexible tubular member, the part having an end portion containing a most downstream end at which the flexible tubular member is directed to a position between the nip member and the backup member;

the nip member including:

a base portion having a first end and a second end positioned downstream of the first end in the sheet feeding direction, the nip region being defined exclusively by the base portion and the backup member;

a connecting portion extending from the first end of the base portion and being bent in a direction away from the backup member, the connecting portion having a first end and a second end connected to the first end of the base portion, a boundary region between the second end of the connecting portion and the first end of the base portion providing a first curved portion; and a flange portion extending from the first end of the connecting portion in a direction opposite to the sheet feeding direction and having a first end and a second end connected to the first end of the connecting portion, the flange portion defining a retaining portion in cooperation with the connecting portion at a position confronting the inner peripheral surface of the flexible tubular member for retaining a lubricant agent, wherein the nip region defines an imaginary plane in the sheet feeding direction, a distance between the most downstream end and the imaginary plane being smaller than a distance between the first end and the imaginary plane.

* * * * *